US009874089B2

(12) United States Patent
Liu et al.

(10) Patent No.: US 9,874,089 B2
(45) Date of Patent: Jan. 23, 2018

(54) BRIDGE TYPE CONCENTRIC DIRECT READING TESTING AND COMMISSIONING INSTRUMENT

(71) Applicant: PETROCHINA COMPANY LIMITED, Beijing (CN)

(72) Inventors: He Liu, Beijing (CN); Xiaohan Pei, Beijing (CN); Fuchao Sun, Beijing (CN); Lichen Zheng, Beijing (CN); Qinghai Yang, Beijing (CN); Yang Gao, Beijing (CN)

(73) Assignee: Petrochina Company Limited, Beijing (CN)

( * ) Notice: Subject to any disclaimer, the term of this patent is extended or adjusted under 35 U.S.C. 154(b) by 431 days.

(21) Appl. No.: 14/765,287

(22) PCT Filed: Jun. 6, 2013

(86) PCT No.: PCT/CN2013/076844
§ 371 (c)(1),
(2) Date: Jul. 31, 2015

(87) PCT Pub. No.: WO2014/117462
PCT Pub. Date: Aug. 7, 2014

(65) Prior Publication Data

US 2015/0369039 A1 Dec. 24, 2015

(30) Foreign Application Priority Data

Feb. 1, 2013 (CN) ..... 2013 1 0042378

(51) Int. Cl.
*E21B 47/10* (2012.01)
*E21B 4/06* (2006.01)
(Continued)

(52) U.S. Cl.
CPC ..... *E21B 47/10* (2013.01); *E21B 4/06* (2013.01); *E21B 23/00* (2013.01); *E21B 43/20* (2013.01)

(58) Field of Classification Search
CPC ..... E21B 47/10; E21B 4/06; E21B 43/20
See application file for complete search history.

(56) References Cited

U.S. PATENT DOCUMENTS

| | | | | |
|---|---|---|---|---|
| 4,116,274 | A | 9/1978 | Rankin et al. | |
| 2001/0035057 | A1 | 11/2001 | Jackson et al. | |
| 2015/0376984 | A1* | 12/2015 | Liu | E21B 43/20 166/330 |

FOREIGN PATENT DOCUMENTS

| | | |
|---|---|---|
| CN | 1601053 | 3/2005 |
| CN | 2707962 | 7/2005 |

(Continued)

OTHER PUBLICATIONS

Search Report dated Feb. 16, 2013 for counterpart Chinese patent application No. 201310042378.3.

(Continued)

*Primary Examiner* — Blake E Michener
(74) *Attorney, Agent, or Firm* — Loza & Loza, LLP; Michael Fedrick

(57) ABSTRACT

A bridge concentric direct-reading testing and adjusting instrument, comprising a cable head connected to a pressure sensor; a supporting mechanism having a pair of supporting arms; a sliding power mechanism including a power motor, a spring, an impact hammer and a one-way clutch assembly, the impact hammer slidably connected to the power motor to be rotated along with rotation of the power motor, a lower end of the impact hammer detachably connected to the one-way clutch assembly, and the one-way clutch assembly connecting the supporting arms via a transmission assembly to control opening and closing of the supporting arms; a (Continued)

flowmeter; and an adjusting actuator including an adjusting motor, an adjusting connector and an adjusting arm, the adjusting arm used for adjusting a waterflooding flow rate through rotation of the adjusting arm.

10 Claims, 8 Drawing Sheets

(51) Int. Cl.
*E21B 43/20* (2006.01)
*E21B 23/00* (2006.01)

(56) References Cited

FOREIGN PATENT DOCUMENTS

| | | |
|---|---|---|
| CN | 2727392 | 9/2005 |
| CN | 200946500 | 9/2007 |
| CN | 101270646 | 9/2008 |
| CN | 201620869 | 10/2009 |
| CN | 201460865 | 5/2010 |
| CN | 201635723 | 11/2010 |
| CN | 201953373 | 8/2011 |
| CN | 202215226 | 5/2012 |
| CN | 102486086 | 6/2012 |
| CN | 102635340 | 8/2012 |
| CN | 203145917 | 8/2013 |

OTHER PUBLICATIONS

First Office Action and search report dated Dec. 5, 2014 for counterpart Chinese patent application No. 201310042378.3.
Search Report dated Nov. 24, 2014 for counterpart Chinese patent application No. 201310042378.3.
Wang, Zhongguo et al., "Downhole Testing and Adjusting Instrument," Oil and Gas Field Surface Engineering (2005) 2:1-10.

* cited by examiner

BRIDGE TYPE CONCENTRIC DIRECT READING TESTING AND COMMISSIONING INSTRUMENT

CROSS-REFERENCE TO RELATED APPLICATIONS

This application is the U.S. national stage of International Patent Application No. PCT/CN2013/076844, filed on Jun. 6, 2013 and entitled BRIDGE-TYPE CONCENTRIC DIRECT READING TESTING AND COMMISSIONING INSTRUMENT, which claims the benefit of priority under 35 U.S.C. §119 from Chinese Patent Application No. 201310042378.3, filed Feb. 1, 2013. The disclosures of the foregoing applications are incorporated herein by reference in their entirety.

TECHNICAL FIELD

The present invention relates to the field of stratified waterflooding of a high-inclination well, in particular to a direct-reading testing and adjusting instrument used for stratified waterflooding of a high-inclination well, and more particularly to a bridge concentric direct-reading testing and adjusting instrument.

BACKGROUND ARTS

In stratified waterflooding of a high-inclination well, when using a conventional eccentric stratified waterflooding process, it is difficult to perform dropping and pulling of a stopper and mating of in-well instruments, making testing and adjusting difficult. By taking the advantages of easy mating of concentric tubular columns in high-inclination wells and provision of auxiliary flow passages by bridge eccentric waterflooding, a bridge concentric water distribution technology is suitable for stratified waterflooding and testing of high-inclination wells.

The current stratified waterflooding process based on the concentric principle can only test the flow rate of a single layer through the diminishing method, and cannot directly test a single layer. This method can ensure a certain degree of measurement accuracy for a waterflooding well with a relatively large single-layer waterflooding amount, but the test error is often unacceptable for a waterflooding well with a relatively small single-layer waterflooding amount, such as an amount less than 30 $m^3$/d. At the same time, the current concentric testing and adjusting instrument is mainly used for straight wells, easy to drop and pull, and has no directional function, so its application in high-inclination wells is limited.

SUMMARY OF THE INVENTION

The purpose of the invention is to provide a bridge concentric direct-reading testing and adjusting instrument cooperating with a bridge concentric water distributor to realize single-layer direct testing and adjusting of high-inclination stratified waterflooding wells.

The above purpose of the present invention can be realized by the following technical solution.

A bridge concentric direct-reading testing and adjusting instrument, comprising: a cable head having a lower end connected to a pressure sensor via a circuit board; a supporting mechanism having a supporting arm fixing base and a pair of supporting arms connected to the supporting arm fixing base; an inclination well sliding power mechanism positioned below the pressure sensor, connected above the supporting mechanism, and including a power motor, a spring, an impact hammer and a one-way clutch assembly, the spring positioned between the power motor and the impact hammer, the impact hammer slidably connected to the power motor and to be rotated along with rotation of the power motor, a lower end of the impact hammer detachably connected to the one-way clutch assembly, and the one-way clutch assembly connecting the supporting arms via a transmission assembly to control opening and closing of the supporting arms; a flowmeter positioned below the supporting mechanism and connected to the circuit board; and an adjusting actuator connected below the flowmeter and including an adjusting motor, an adjusting connector and an adjusting arm, the adjusting motor connected to the adjusting arm via the adjusting connector, and the adjusting arm used for adjusting a waterflooding flow rate through rotation of the adjusting arm.

The bridge concentric direct-reading testing and adjusting instrument has the following characteristics and advantages: it can realize stratified waterflooding and testing of high-inclination wells by cooperating with a bridge concentric water distributor. This testing and adjusting instrument not only can realize single-layer direct testing to improve the testing accuracy, but also has orientation function through which an inclination well sliding power mechanism can vibrate during dropping and pulling of the testing and adjusting instrument to facilitate dropping and pulling of the testing and adjusting instrument in high-inclination wells. It has high adaptability for the stratified testing of high-inclination waterflooding wells.

BRIEF DESCRIPTION OF THE DRAWINGS

In order to clearly illustrate the technical solutions of the embodiments of the invention, the drawings used in the description of the embodiments are briefly described. Obviously, the following figures are only some embodiments of the invention, and other figures can be obtained by persons of ordinary technical knowledge in the field without creative work.

DETAILED DESCRIPTION OF THE EMBODIMENTS

Figure 1:
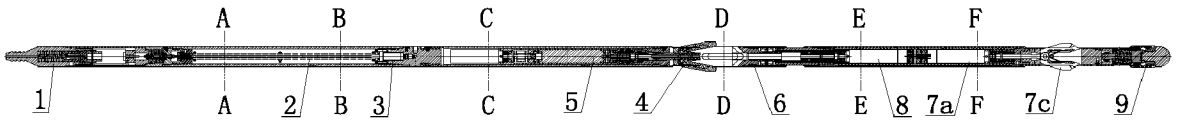
FIG. 1 is a schematic sectional view of the bridge concentric direct-reading testing and adjusting instrument of an embodiment of the invention.
Figure 2:
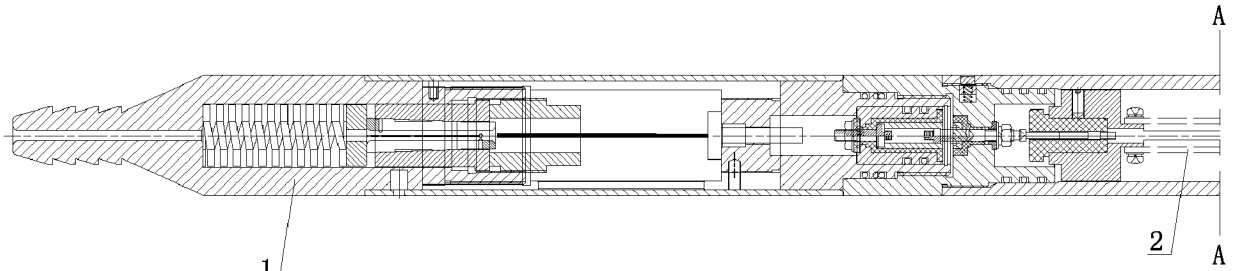
FIG. 2 is a schematic partial enlargement view of the part above the A-A line in FIG. 1.
Figure 3:
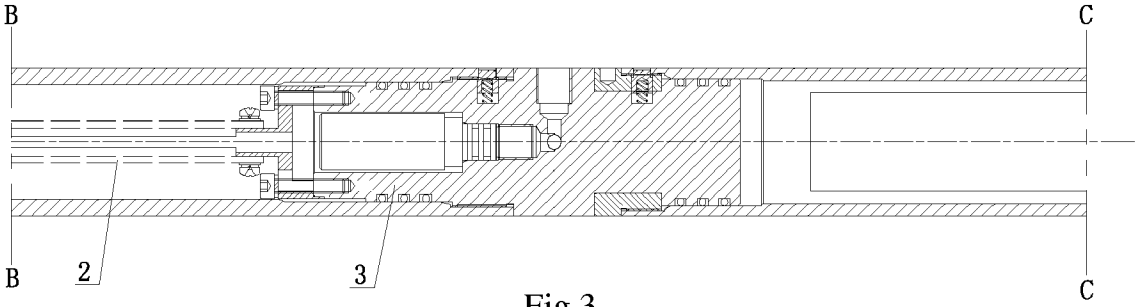
FIG. 3 is a schematic partial enlargement view of the part between the B-B line and the C-C line in FIG. 1.

The technical solutions of the embodiments of the invention will be described below clearly and completely with reference to the figures for the embodiments. Obviously, the described embodiments are only a portion of rather than all of the embodiments of the invention. Based on the embodiments of the invention, person skilled in the art can obtain other embodiments within the scope of this invention without creative work.

The upper and lower positions are defined with respect to the use state in this invention. Specifically, one end of the cable head is the upward direction and one end of the sealing bladder is the downward direction.

As FIG. 1 to FIG. 11 show, an embodiment of the invention proposes a bridge concentric direct-reading testing and adjusting instrument, comprising: a cable head 1 having a lower end connected to a pressure sensor 3 via a circuit board 2; a circuit board 2; a pressure sensor 3; a supporting mechanism 4 having a supporting arm fixing base 4*b* and a pair of supporting arms 4*a* connected to the supporting arm fixing base 4*b*; an inclination well sliding power mechanism 5 positioned below the pressure sensor 3, connected above the supporting mechanism 4, and including a power motor 5*a*, a spring 5*b*, an impact hammer 5*c* and a one-way clutch assembly 5*d*, the spring 5*b* positioned between the power motor 5*a* and the impact hammer 5*c*, the impact hammer 5*c* slidably connected to the power motor 5*a* and to be rotated along with rotation of the power motor 5*a*, a lower end of the impact hammer 5*c* detachably connected to the one-way clutch assembly 5*d*, and the one-way clutch assembly 5*d* connecting the supporting arms 4*a* via a transmission assembly 5*e* to control opening and closing of the supporting arms 4*a*; a flowmeter 6 positioned below the supporting mechanism 4 and connected to the circuit board 2 for measuring the flow rate of each layer and segment; and an adjusting actuator 7 connected below the flowmeter 6 and including an adjusting motor 7*a*, an adjusting connector 7*b* and an adjusting arm 7*c*, the adjusting motor 7*a* connected to the adjusting arm 7*c* via the adjusting connector 7*b*, and the adjusting arm 7*c* used for adjusting a waterflooding flow rate through rotation of the adjusting arm 7*c*.

In this embodiment, when the power motor 5*a* of the inclination well sliding power mechanism 5 rotates, the impact hammer 5*c* also rotates accordingly. The power motor 5*a* of the inclination well sliding power mechanism 5 is also used for the supporting arms 4*a*. Two different functions are realized through the one-way clutch assembly 5*e*. Namely, for example, when the power motor 5*a* rotates backwards, the impact hammer 5*c* of the inclination well sliding power mechanism 5 is driven to impact, which provides a sliding force to the testing and adjusting instrument, so that dropping and pulling of the testing and adjusting instrument in high-inclination wells is facilitated. Namely, for example, when the power motor 5*a* rotates forwards, the supporting arms 4*a* are driven to close or open. When the supporting arms 4*a* are opened, mating between the supporting arms 4*a* and a positioning shell of a bridge concentric water distributor can be performed for positioning, so that the flowmeter 6 and the pressure sensor 3 can test directly in the current layer of a stratified waterflooding well, thereby improving the testing accuracy. When the supporting arms 4*a* are closed, the testing and adjusting instrument can be pulled upwards or dropped to another layer of the stratified waterflooding well for testing and adjusting.

According to one embodiment of this invention as shown in FIGS. 8-12, the one-way clutch assembly 5*d* includes an one-way clutch shaft 5*d*1, an one-way clutch fixing base 5*d*2, an one-way thrust ball bearing 5*d*3 and an one-way clutch 5*d*4, the one-way clutch fixing base 5*d*2 being fitted outside the one-way clutch shaft 5*d*1, the one-way clutch 5*d*4 being provided between the one-way clutch fixing base 5*d*2 and the one-way clutch shaft 5*d*1, a shaft head of the one-way clutch shaft 5*d*1 having an embedding portion 5*d*5, the one-way thrust ball bearing 5*d*3 being fitted outside the one-way clutch shaft 5*d*1 and provided between the shaft head and the one-way clutch fixing base 5*d*2. One end of the transmission assembly 5*e* is circumferentially and fixedly connected to the inside of the one-way clutch shaft 5*d*1. A lower end of the impact hammer 5*c* is fixedly connected to a shaft sleeve 5*c*1 which is embedded in the embedding portion 5*d*5 when the one-way clutch 5*d*4 is unlocked and which is detached from the embedding portion 5*d*5 when the one-way clutch 5*d*4 is locked.

In this embodiment, the one-way clutch fixing base 5*d*2 is fixed, i.e., it cannot rotate. When the power motor 5*a* rotates forwards, the one-way clutch 5*d*4 is unlocked; by way of rotation of the impact hammer 5*c*, the shaft sleeve 5*c*1 can be easily embedded in the embedding portion 5*d*5 to drive the one-way clutch shaft 5*d*1 to rotate; since one end of the transmission assembly 5*e* is circumferentially and fixedly connected to the inside of the one-way clutch shaft 5*d*1, the transmission assembly 5*e* is rotated accordingly, thereby opening or closing the supporting arms 4*a*. When the power motor 5*a* rotates backwards, the one-way clutch 5*d*4 is locked; by way of rotation of the impact hammer 5*c*, the shaft sleeve 5*c*1 is detached from the embedding portion 5*d*5, whereby the transmission assembly 5*e* does not rotate and the supporting arms 4*a* do not act; that is, the power motor 5*a* only controls rotation of the impact hammer 5*c*, presses the spring 5*b* and releases the spring force to generate impact, providing a downward sliding force for the instrument.

Figure 12:
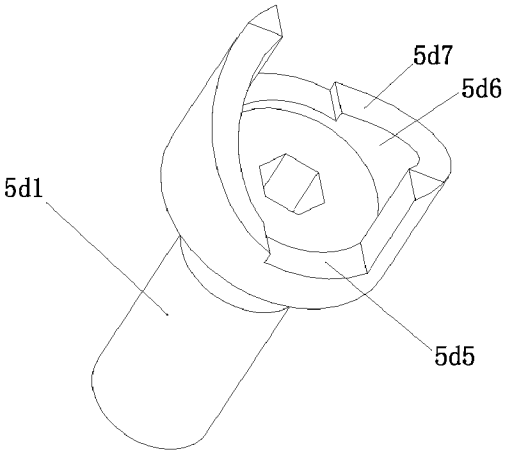
FIG. 12 is a schematic perspective view of the shaft of the one-way clutch assembly of the inclination well sliding power mechanism of the bridge concentric direct-reading testing and adjusting instrument of an embodiment of the invention.

As shown in FIG. 12, the shaft head of the one-way clutch shaft 5*d* includes a functional conversion portion including a group of two-eared pulleys 5*d*6 and a group of dual-spiral slopes 5*d*7, an end face of the two-eared pulley 5*d*6 being a dual-spiral slope 5*d*7, and the embedding portion 5*d*5 being formed between the two-eared pulleys 5*d*6. Using the functional conversion portion of this embodiment, the shaft sleeve 5*c*1 of impact hammer 5*c* can easily slide into the embedding portion 5*d*5 when rotating forwards or out of the embedding portion 5*d*5 when rotating backwards.

According to one embodiment of this invention, the transmission assembly 5*e* includes a transmission shaft 5*e*1, a supporting wheel 5*e*2 and a cam 5*e*3, the transmission shaft 5*e*1 being circumferentially and fixedly connected to the inside of the one-way clutch shaft 5*d*1, the supporting wheel 5*e*2 and the cam 5*e*3 being respectively circumferentially and fixedly fitted outside the transmission shaft 5*e*1, the cam 5*e*3 being positioned below the supporting wheel 5*e*2, the outside of the cam 5*e*3 being connected to one end of the supporting arms 4*a*, and the other end of the supporting arms 4*a* being opened or closed as the cam 5*e*3 rotates.

Further, the outside of the transmission shaft 5*e*1 is fitted by a base pressing ring 5*e*4 and a transmission spring 5*e*5, the base pressing ring 5*e*4 being circumferentially fixed relative to the transmission shaft 5*e*1 and being positioned below the one-way clutch assembly 5*d*, one end of the transmission spring 5*e*5 abutting against the base pressing ring 5*e*4, and the other end thereof abutting against the supporting wheel 5*e*2.

In this embodiment, when the one-way clutch shaft 5*d*1 is rotated, the transmission shaft 5*e*1 connected inside the one-way clutch shaft 5*d*1 is also rotated, thereby driving the supporting wheel 5*e*2 and the cam 5*e*3 to rotate. The cam 5*e*3 has different diameters, so that when the supporting arms 4*a* are opened or closed, the supporting wheel 5*e*2 and the cam 5*e*3 can slide upwards or downwards along the transmission shaft 5*e*1 under the action of the transmission spring 5*e*5 and the tensile force of the supporting arms 4*a*, thereby preventing blockage of the supporting arms 4*a*.

Figure 5:
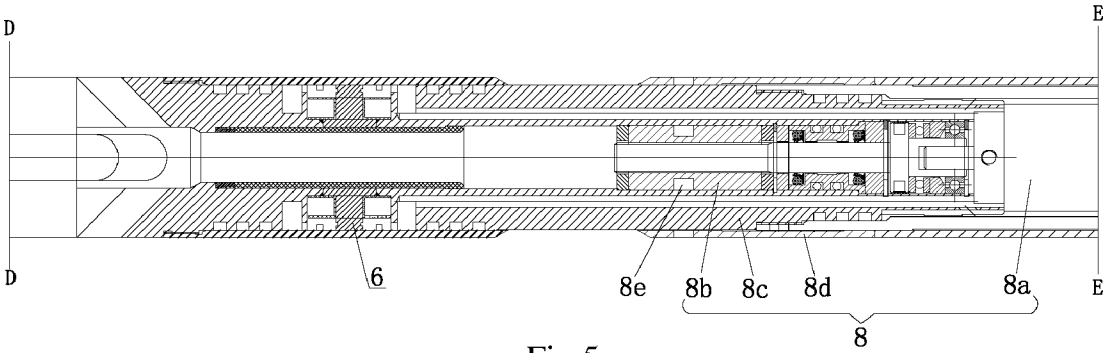
FIG. 5 is a schematic partial enlargement view of the part between the D-D line and the E-E line in FIG. 1.
Figure 4:
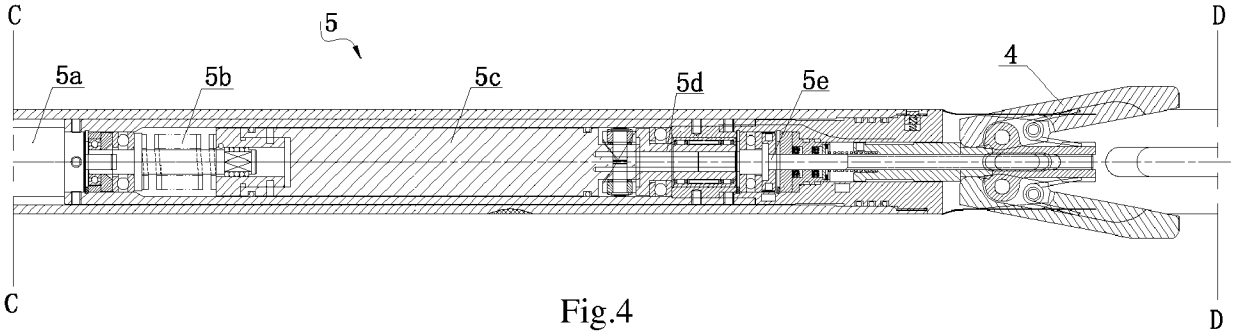
FIG. 4 is a schematic partial enlargement view of the part between the C-C line and the D-D line in FIG. 1.
Figure 4A:
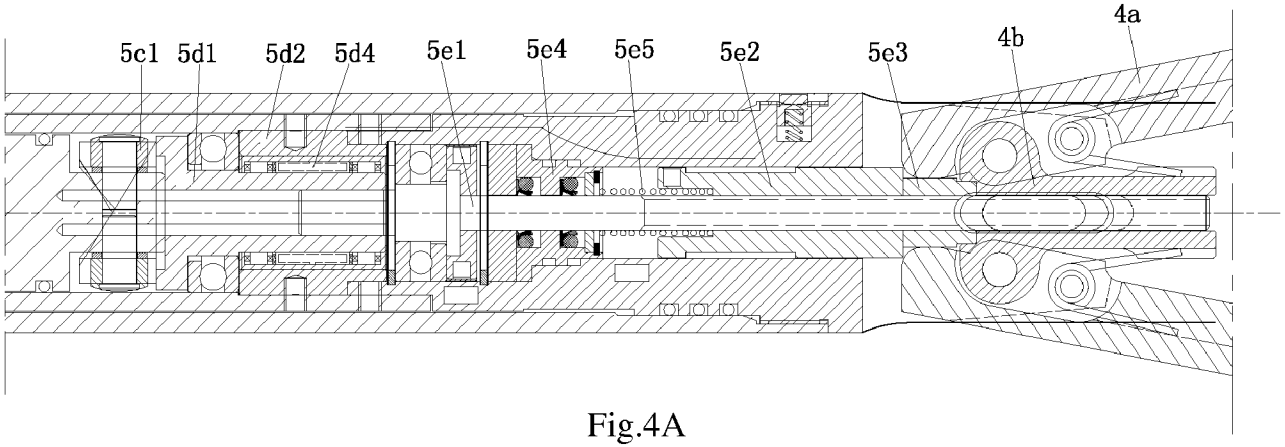
FIG. 4A is a schematic partial enlargement view of FIG. 4.
Figure 4B:
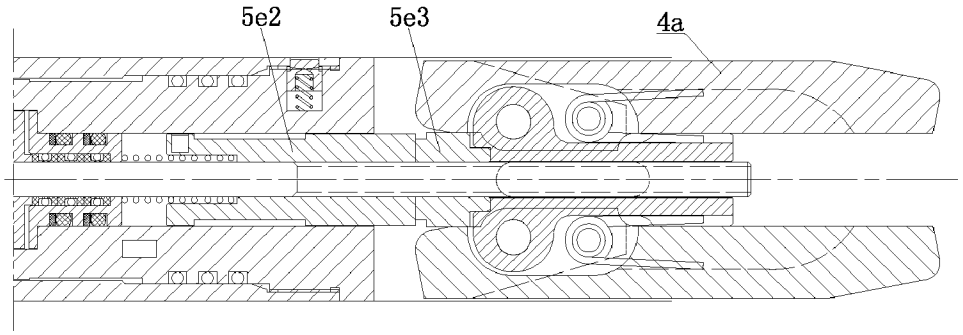
FIG. 4B is a schematic view of the bridge concentric direct-reading testing and adjusting instrument of an embodiment of the invention with the supporting arms closed.
Figure 6:
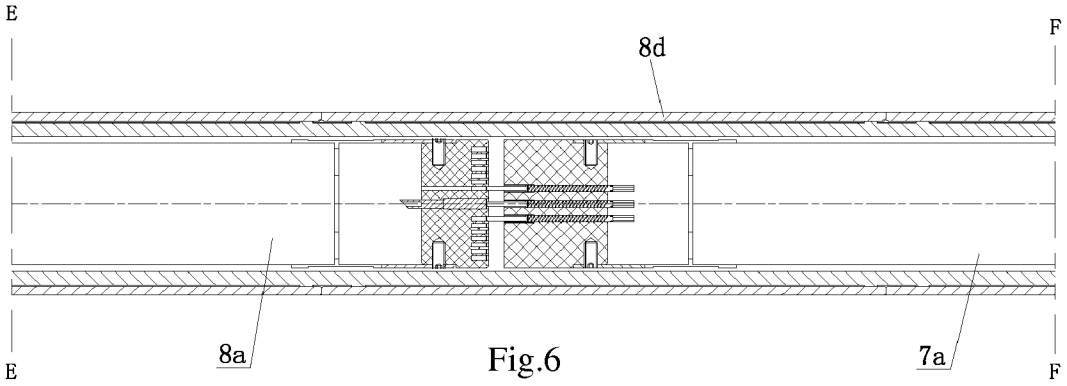
FIG. 6 is a schematic partial enlargement view of the part between the E-E line and the F-F line in FIG. 1.
Figure 7:
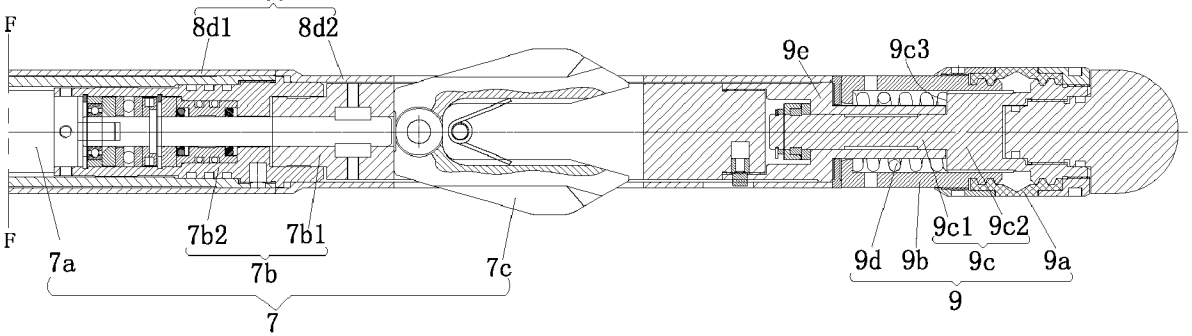
FIG. 7 is a schematic partial enlargement view of the part below the F-F line in FIG. 1.
Figure 8:
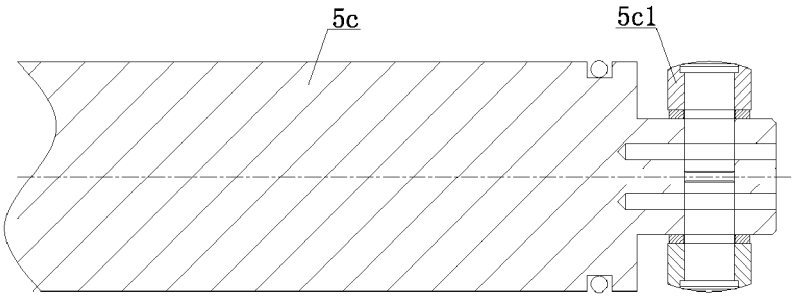
FIG. 8 is a schematic view of the bridge concentric direct-reading testing and adjusting instrument of an embodiment of the invention with an active part of the clutch of the inclination well sliding power mechanism connected to the impact hammer.
Figure 9:
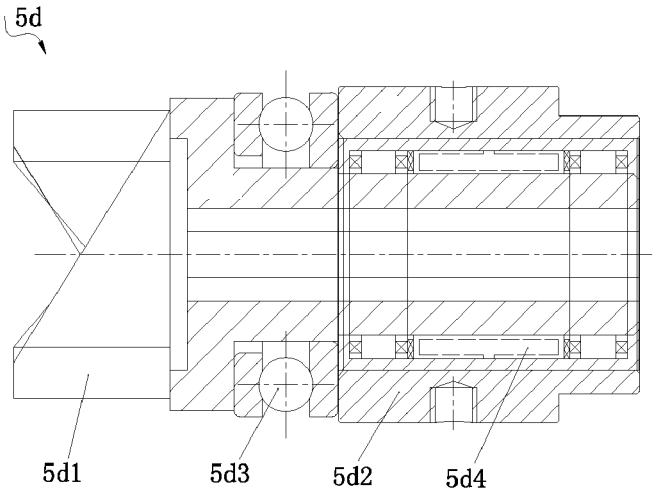
FIG. 9 is a schematic sectional view of the one-way clutch assembly of the inclination well sliding power mechanism of the bridge concentric direct-reading testing and adjusting instrument of an embodiment of the invention.
Figure 10:
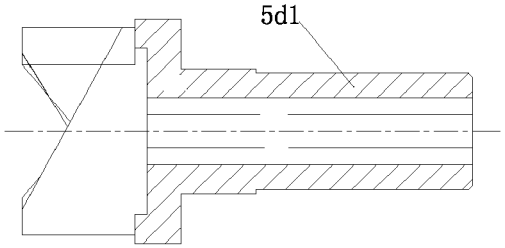
FIG. 10 is a schematic front sectional view of the shaft of the one-way clutch assembly of the inclination well sliding power mechanism of the bridge concentric direct-reading testing and adjusting instrument of an embodiment of the invention.
Figure 11:
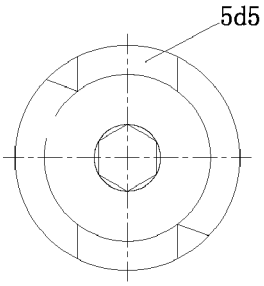
FIG. 11 is a schematic left view of the shaft of the one-way clutch assembly of the inclination well sliding power mechanism of the bridge concentric direct-reading testing and adjusting instrument of an embodiment of the invention.

According to one embodiment of this invention as shown in FIGS. 5-7, the bridge concentric direct-reading testing and adjusting instrument further comprises a bladder actuator 8 and a sealing bladder assembly 9, the bladder actuator 8 being connected above the sealing bladder assembly 9, the sealing bladder assembly 9 being connected below the adjusting actuator 7 and including a sealing bladder 9*a*, which can be expanded or contracted via the bladder actuator 8.

Figure 13:
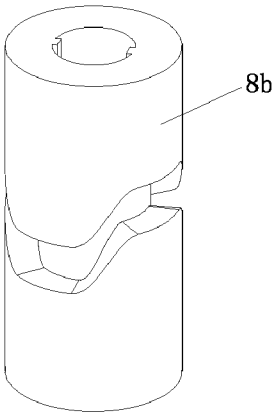
FIG. 13 is a schematic perspective view of the tubular cam of the bladder actuator of the bridge concentric direct-reading testing and adjusting instrument of an embodiment of the invention.

As shown in FIGS. 5 and 13, the bladder actuator 8 includes a bladder motor 8*a*, a cylindrical cam 8*b*, an inner sliding sleeve 8*c* and an outer sliding sleeve 8*d*, the bladder motor 8*a* driving the cylindrical cam 8*b* to rotate, the outer sliding sleeve 8*d* being connected to the outside of the inner sliding sleeve 8*c*, the inner sliding sleeve 8*c* and the outer sliding sleeve 8*d* capable of sliding upwards or downwards together as the cylindrical cam 8*b* rotates, and the sealing bladder assembly 9 driving the sealing bladder 9*a* to be expanded by pressing or contracted by pulling as the outer sliding sleeve 8*d* slides upwards or downwards.

A passive protrusion 8*e* is provided inside the inner sliding sleeve 8*c* and is embedded in a groove of the cylindrical cam 8*b*. When the bladder motor 8*a* starts to drive the cylindrical cam 8*b* rotate, the inner sliding sleeve 8*c* and the outer sliding sleeve 8*d* slide upwards or downwards together through cooperation between the passive protrusion 8*e* and the groove of the cylindrical cam 8*b*. When the outer sliding sleeve 8*d* slides downwards to push the sealing bladder assembly 9 downwards, the sealing bladder 9*a* is pressed to expand, so that the sealing segments of the bridge concentric water distributor are sealed, meeting the requirements for testing, adjusting or seal-checking. When testing, adjusting or seal-checking is completed, the outer sliding sleeve 8*d* may slide upwards, and the sealing bladder assembly 9 can contract by pulling the sealing bladder 9*a*.

As FIG. 7 shows, the sealing bladder assembly 9 further includes: a bladder fixing sleeve 9*b* having an upper end connected to the outer sliding sleeve 8*d* and capable of sliding upwards or downwards; a bladder supporting shaft 9*c* in the form of a stepped shaft having a first shaft portion 9*c*1 and a second shaft portion 9*c*2, with a stepped surface 9*c*3 being provided between the first shaft portion 9*c*1 and the second shaft portion 9*c*2, one end of the sealing bladder 9*a* being fixedly connected to the bladder fixing sleeve 9*b*, and the other end of the sealing bladder 9*a* being fixedly connected to the bladder supporting shaft 9*c*; and a restoration spring 9*d* fitted outside the first shaft portion 9*c*1 and having one end abutting against the bladder fixing sleeve 9*b* and the other end abutting against the stepped surface 9*c*3 of the bladder supporting shaft 9*c*.

Further, an intermediate shaft 9*e* is fitted outside the first shaft portion 9*c*1 of the bladder supporting shaft 9*c*, the restoration spring 9*d* fitted outside the intermediate shaft 9*e*, and both ends of the restoration spring 9*d* abut against the bladder fixing sleeve 9*b* and the bladder supporting shaft 9*c* respectively.

Since the bladder actuator 8 and the sealing bladder assembly 9 are separated by the adjusting actuator 7, a long distance is generated therebetween. If the outer sliding sleeve 8*d* is integrally formed, the length will be large. Therefore, the outer sliding sleeve 8*d* may be formed into a first outer sliding sleeve 8*d*1 and a second outer sliding sleeve 8*d*2 in an up-down order, with the first outer sliding sleeve 8*d*1 fixedly connected to the inner sliding sleeve 8*c* and the second outer sliding sleeve 8*d*2 to the bladder fixing sleeve 9*b*.

In this embodiment, the bladder motor 8*a* is started to drive the cylindrical cam 8*b* to rotate. When the inner sliding sleeve 8*c* and the first outer sliding sleeve 8*d*1 slide downwards, the bladder fixing sleeve 9*b* is pushed downwards via the second outer sliding sleeve 8*d*2, and drives the upper end of the sealing bladder 9*a* to move downwards. At this time, the bladder supporting shaft 9*c* does not move, or the lower end of the sealing bladder 9*a* does not move, so that the sealing bladder 9*a* is pressed to expand. If the sealing bladder 9*a* needs to expand continuously, the bladder motor 8*a* may be stopped when the first outer sliding sleeve 8*d*1 is at the lowermost position. If the sealing bladder 9*a* does not need to expand, the bladder motor 8*a* may be started, whereby the first outer sliding sleeve 8*d*1 is moved to the uppermost position, the bladder fixing sleeve 9*b* slides upwards under the action of the restoration spring 9*d* and pushes the second outer sliding sleeve 8*d*2 to slide upwards, so that the upper end of the sealing bladder 9*a* is pulled upwards to contract.

According to one embodiment of this invention as shown in FIG. 7, the adjusting connector 7*b* includes an adjusting arm fixing groove 7*b*1 connected to the adjusting arm 7*c*, and an adjusting and rotating shaft 7*b*2 having one end connected to the adjusting motor 7*a* and the other end thereof to the adjusting arm fixing groove 7*b*1.

In this embodiment, when the adjusting motor 7*a* is started to drive the adjusting and rotating shaft 7*b*2 and the adjusting arm fixing groove 7*b*1 to rotate, the adjusting arm 7*c* connected to the adjusting arm fixing groove 7*b*1 also rotates accordingly. The rotating shaft of the adjusting motor 7*a* can rotate forwards or backwards, so that the adjusting arm 7*c* can rotate forwards or backwards synchronously, whereby the opening degree of a water nozzle can be regulated to realize a suitable waterflooding flow rate for the current layer.

In addition, the cable head 1 is a cable terminal connector having one end connectable with electrical equipment. The mechanical part of the cable head 1 is used to not only seal the cable head but function as a transition to a lower mechanical structure.

The circuit board 2 can be in the structure of a double-layered circuit board. The circuit board 2 is installed with various electrical components of the control and measuring circuits of the in-well part of the whole instrument that are mainly used to transmit measurement data, measure in-well flow rates, in-well pressures, in-well temperatures, voltages of the cable head, working currents of the motors and working states of the instrument, slide and vibrate the instrument, close/open the supporting arms, press and seal the sealing bladder and adjust flow rates etc.

The flowmeter 6 can be an electromagnetic flowmeter. The motors can be the variable frequency servo motors. The pressure sensor 3 is mainly used for measuring the water injection pressure of each layer and segment, and feeding back electrical signals to the ground instrument through the circuit board.

The work procedure of this embodiment is described as follows:

Connect a cable to the cable head 1; carry the testing and adjusting instrument into the well; control the supporting arms 4*a* to close via the power motor 5*a* in an initial state; control the supporting arms 4*a* to open via the power motor 5*a* when the testing and adjusting instrument arrives at the first layer, such as at a depth of about 100 meters; position and dock the supporting arms 4*a* with the water distributor when the supporting arms 4*a* arrive at the positioning step of the water distributor in the first layer; press the sealing bladder 9*a* to expand via the bladder motor 8*a*, namely, seal the sealing bladder 9*a* in a sealing segment of the water distributor; rotate the adjusting arm 7*c* via the adjusting motor 7*a*; automatically adjust the waterflooding amount according to preset instructions to realize automatic water distribution; monitor the in-well flow rate and pressure via the flowmeter 6 and the pressure sensor 3 and transmit the same to the ground for real-time display through cables; when the testing and adjusting instrument encounters large resistance or arrives at a high-inclination position during the dropping process, perform impact using the impact hammer 5*c* controlled by the power motor 5*a* to make the instrument vibrate axially, and to improve the ascending and descending capability of the instrument, thereby meeting the stratified waterflooding requirement for high-inclination wells; and after testing is finished, control the supporting arms 4*a* to close via the power motor 5*a*.

The above embodiments are a part of the embodiments of the present invention, and can be modified or combined by those skilled in the art according to the content disclosed by the application documents without departing from the spirit and scope of the invention.

The invention claimed is:

1. A bridge concentric direct-reading testing and adjusting instrument, comprising:

a cable head (1) having a lower end connected to a pressure sensor (3) via a circuit board (2);

a supporting mechanism (4) having a supporting arm fixing base (4*b*) and a pair of supporting arms (4*a*) connected to the supporting arm fixing base (4*b*);

an inclination well sliding power mechanism (5) positioned below the pressure sensor (3), the power mechanism being connected above the supporting mechanism (4) and including a power motor (5*a*), a spring (5*b*), an impact hammer (5*c*) and a one-way clutch assembly (5*d*), the spring (5*b*) positioned between the power motor (5*a*) and the impact hammer (5*c*), the impact hammer (5*c*) slidably connected to the power motor (5*a*) and to be rotated along with rotation of the power motor (5*a*), a lower end of the impact hammer (5*c*) detachably connected to the one-way clutch assembly (5*d*), and the one-way clutch assembly (5*d*) connecting the supporting arms (4*a*) via a transmission assembly (5*e*) to control opening and closing of the supporting arms (4*a*);

a flowmeter (6) positioned below the supporting mechanism (4) and connected to the circuit board (2); and an adjusting actuator (7) connected below the flowmeter (6) and including an adjusting motor (7*a*), an adjusting connector (7*b*) and an adjusting arm (7*c*), the adjusting motor (7*a*) being connected to the adjusting arm (7*c*) via the adjusting connector (7*b*), wherein the adjusting arm (7*c*) can adjust a waterflooding flow rate through rotation of the adjusting arm (7*c*).

2. The bridge concentric direct-reading testing and adjusting instrument according to claim 1, wherein the one-way clutch assembly (5*d*) includes an one-way clutch shaft (5*d*1), an one-way clutch fixing base (5*d*2), an one-way thrust ball bearing (5*d*3) and an one-way clutch (5*d*4), the one-way clutch fixing base (5*d*2) being fitted outside the one-way clutch shaft (5*d*1), the one-way clutch (5*d*4) being provided between the one-way clutch fixing base (5*d*2) and the one-way clutch shaft (5*d*1), a shaft head of the one-way clutch shaft (5*d*1) having an embedding portion (5*d*5), the one-way thrust ball bearing (5*d*3) being fitted outside the one-way clutch shaft (5*d*1) and provided between the shaft head and the one-way clutch fixing base (5*d*2), one end of the transmission assembly (5*e*) being circumferentially and fixedly connected to the inside of the one-way clutch shaft (5*d*1), and a lower end of the impact hammer (5*c*) being fixedly connected to a shaft sleeve (5*c*1) which is embedded in the embedding portion (5*d*5) when the one-way clutch (5*d*4) is unlocked and which is detached from the embedding portion (5*d*5) when the one-way clutch (5*d*4) is locked.

3. The bridge concentric direct-reading testing and adjusting instrument according to claim 2, wherein the transmission assembly (5*e*) includes a transmission shaft (5*e*1), a supporting wheel (5*e*2) and a cam (5*e*3), the transmission shaft (5*e*1) being circumferentially and fixedly connected to the inside of the one-way clutch shaft (5*d*1), the supporting wheel (5*e*2) and the cam (5*e*3) being respectively circumferentially and fixedly fitted outside the transmission shaft (5*e*1), the cam (5*e*3) being positioned below the supporting wheel (5*e*2), the outside of the cam (5*e*3) being connected to one end of the supporting arms (4*a*), and the other end of the supporting arms (4*a*) being opened or closed as the cam (5*e*3) rotates.

4. The bridge concentric direct-reading testing and adjusting instrument according to claim 3, wherein the outside of the transmission shaft (5*e*1) is fitted by a base pressing ring (5*e*4) and a transmission spring (5*e*5), the base pressing ring (5*e*4) being circumferentially fixed relative to the transmission shaft (5*e*1) and being positioned below the one-way clutch assembly (5*d*), one end of the transmission spring (5*e*5) abutting against the base pressing ring (5*e*4), and the other end thereof abutting against the supporting wheel (5*e*2).

5. The bridge concentric direct-reading testing and adjusting instrument according to claim 2, wherein the shaft head of the one-way clutch shaft (5*d*1) includes a functional conversion portion including a group of two-eared pulleys (5*d*6) and a group of dual-spiral slopes (5*d*7), an end face of the two-eared pulley (5*d*6) being the dual-spiral slope (5*d*7), and the embedding portion (5*d*5) being formed between the two-eared pulleys (5*d*6).

6. The bridge concentric direct-reading testing and adjusting instrument according to claim 1, wherein the bridge concentric direct-reading testing and adjusting instrument further comprises a bladder actuator (8) and a sealing bladder assembly (9), the bladder actuator (8) being connected above the sealing bladder assembly (9), and the sealing bladder assembly (9) being connected below the adjusting actuator (7) and including a sealing bladder (9*a*), which can be expanded or contracted via the bladder actuator (8).

7. The bridge concentric direct-reading testing and adjusting instrument according to claim 6, wherein the bladder actuator (8) includes a bladder motor (8*a*), a cylindrical cam (8*b*), an inner sliding sleeve (8*c*) and an outer sliding sleeve (8*d*), the bladder motor (8*a*) driving the cylindrical cam (8*b*) to rotate, the outer sliding sleeve (8*d*) being connected to the outside of the inner sliding sleeve (8*c*), the inner sliding sleeve (8*c*) and the outer sliding sleeve (8*d*) capable of sliding upwards or downwards together as the cylindrical cam (8*b*) rotates, and the sealing bladder assembly (9) driving the sealing bladder (9*a*) to be expanded by pressing or contracted by pulling as the outer sliding sleeve (8*d*) slides upwards or downwards.

8. The bridge concentric direct-reading testing and adjusting instrument according to claim 7, wherein the sealing bladder assembly (9) further includes:

a bladder fixing sleeve (9*b*) having an upper end connected to the outer sliding sleeve (8*d*) and capable of sliding upwards or downwards;

a bladder supporting shaft (9*c*) in the form of a stepped shaft having a first shaft portion (9*c*1) and a second shaft portion (9*c*2), with a stepped surface (9*c*3) being provided between the first shaft portion (9*c*1) and the second shaft portion (9*c*2), one end of the sealing bladder (9*a*) being fixedly connected to the bladder fixing sleeve (9*b*), and the other end of the sealing bladder (9*a*) being fixedly connected to the bladder supporting shaft (9*c*); and a restoration spring (9*d*) fitted outside the first shaft portion (9*c*1) and having one end abutting against the bladder fixing sleeve (9*b*) and the other end abutting against the stepped surface (9*c*3) of the bladder supporting shaft (9*c*).

9. The bridge concentric direct-reading testing and adjusting instrument according to claim 8, wherein the outer sliding sleeve (8*d*) is formed into a first outer sliding sleeve (8*d*1) and a second outer sliding sleeve (8*d*2) in an up-down order, with the first outer sliding sleeve (8*d*1) fixedly connected to the inner sliding sleeve (8*c*) and the second outer sliding sleeve (8*d*2) to the bladder fixing sleeve (9*b*).

10. The bridge concentric direct-reading testing and adjusting instrument according to claim 1, wherein the adjusting connector (7*b*) includes an adjusting arm fixing groove (7*b*1) connected to the adjusting arm (7*c*) and an adjusting and rotating shaft (7*b*2) having one end connected to the adjusting motor (7*a*) and the other end connected to the adjusting arm fixing groove (7*b*1).

* * * * *